US010273946B2

(12) United States Patent
Bronson

(10) Patent No.: US 10,273,946 B2
(45) Date of Patent: Apr. 30, 2019

(54) ROTARY FLUID DEVICE WITH BENT CYLINDER SLEEVES

(71) Applicant: Bronson & Bratton, Inc., Burr Ridge, IL (US)

(72) Inventor: Mark R. Bronson, Hinsdale, IL (US)

(73) Assignee: Bronson & Bratton, Inc., Burr Ridge, IL (US)

( * ) Notice: Subject to any disclaimer, the term of this patent is extended or adjusted under 35 U.S.C. 154(b) by 486 days.

(21) Appl. No.: 14/935,116

(22) Filed: Nov. 6, 2015

(65) Prior Publication Data

US 2017/0130704 A1 May 11, 2017

(51) Int. Cl.
*F01B 3/00* (2006.01)
*F04B 1/24* (2006.01)
*F03C 1/06* (2006.01)

(52) U.S. Cl.
CPC ..... *F04B 1/24* (2013.01); *F01B 3/0038* (2013.01); *F03C 1/0642* (2013.01)

(58) Field of Classification Search
CPC .. F04B 1/24; F04B 1/32; F01B 3/0038; F02B 75/22; F02B 75/32
See application file for complete search history.

(56) References Cited

U.S. PATENT DOCUMENTS 2,117,521 A 5/1938 Stevens
3,626,911 A 12/1971 Shaw
3,902,466 A 9/1975 Gulko
3,902,468 A 9/1975 Turner
4,648,358 A * 3/1987 Sullivan ..... F01B 3/0038 123/43 A
4,867,107 A 9/1989 Sullivan et al.
5,052,898 A * 10/1991 Cook ..... F04B 1/24 417/269
5,159,902 A * 11/1992 Grimm ..... F01B 3/0038 123/43 A
6,913,447 B2 4/2005 Fox et al.
7,311,034 B2 12/2007 Achten
(Continued)

FOREIGN PATENT DOCUMENTS

DE 19747915 A1 * 5/1999 ..... F04B 1/2071
GB 1556160 A 11/1979

*Primary Examiner* — Nathaniel Wiehe
*Assistant Examiner* — Abiy Teka
(74) *Attorney, Agent, or Firm* — Leydig, Voit & Mayer, Ltd.

(57) ABSTRACT

A rotary fluid pump-motor includes first and second rotor assemblies and a bent cylinder sleeve. The first rotor assembly includes a first rotor, a piston cylinder, and a flange ring with an inclined guide surface. The second rotor assembly includes a second rotor and a piston. The first and second rotors are rotatably movable about inclined first and second rotor axes, respectively. The bent cylinder sleeve receives the piston cylinder and the piston therein through respective sleeve openings to define a piston chamber therebetween. The bent cylinder sleeve is in at least intermittent contacting relationship with the flange ring's inclined guide surface and rotatably movable about the first rotor axis with respect to the inclined guide surface such that the bent cylinder sleeve moves along the first rotor axis relative to the piston cylinder based upon its circumferential position along the inclined guide surface to correspondingly vary the piston chamber's volume.

20 Claims, 11 Drawing Sheets

(56) References Cited

U.S. PATENT DOCUMENTS

| | | | |
|---|---|---|---|
| 7,677,210 | B2 | 3/2010 | Chaslin et al. |
| 7,731,485 | B2 | 6/2010 | Achten |
| 7,967,574 | B2 | 6/2011 | Achten |
| 2006/0034703 | A1 | 2/2006 | Fox et al. |
| 2010/0028169 | A1 | 2/2010 | Nelson et al. |

* cited by examiner

ROTARY FLUID DEVICE WITH BENT CYLINDER SLEEVES

TECHNICAL FIELD

This patent disclosure relates generally to a rotary fluid device, and more particularly to a rotary fluid device that can be configured to operate as a pump or a motor.

BACKGROUND

Typical swashplate pumps and motors can include a rotating cylinder containing pistons. An auxiliary cam plate holds the pistons against a stationary swash plate which sits at an angle to the cylinder. In pump mode, the device converts mechanical energy into hydraulic pressure. A pair of port openings is in selective communication with the pistons. The pistons pull in fluid during half a revolution when they are in communication with one of the port openings and push fluid out under pressure during the other half of the revolution when they are in communication with the other of the port openings. The port openings allow the pistons to draw in fluid as they move away from the port plate and discharge it as they move toward the port plate. For a given speed, swashplate pumps can be of fixed displacement, or can be variable by being equipped with a variable angle swashplate to correspondingly vary the pump displacement for that speed. The greater the swashplate angle, the more the pistons reciprocally translate and the more fluid they transfer. In motor mode, the swashplate motor converts hydraulic pressure into mechanical torque and angular displacement of a shaft. The swashplate motor operates in a similar, but reverse, fashion as a swashplate pump.

U.S. Pat. No. 5,052,898 is entitled, "Bent Axis Compressor," and is directed to a bent-axis compressor in which a plurality of spaced bent-axis double acting reciprocating pistons are operatively joined to two separate rotatable cylinder blocks driven by a power transmission around a stationary bent axis central shaft. The central shaft and the pistons are hollow. A vapor inlet port is located at the center of each piston at the plane joining the two halves of the piston and on the side having an exterior obtuse included angle between the two halves. Valved passageways lead from inside the piston to each head of the respective cylinder and from the cylinder head to the interior of the central shaft for exit therefrom as a compressed vapor.

There is a continued need in the art to provide additional solutions for hydraulic pump/motors. For example, there is a continued need for a relatively simple hydraulic device that can use different types of fluids in addition to hydraulic oil as the working fluid. It can be difficult to operate swashplate pumps/motors using a fluid other than hydraulic oil.

It will be appreciated that this background description has been created by the inventor to aid the reader, and is not to be taken as an indication that any of the indicated problems were themselves appreciated in the art. While the described principles can, in some respects and embodiments, alleviate the problems inherent in other systems, it will be appreciated that the scope of the protected innovation is defined by the attached claims, and not by the ability of any disclosed feature to solve any specific problem noted herein.

SUMMARY OF THE DISCLOSURE

The present disclosure provides embodiments of a hydraulic device that can operate as a pump and/or a motor.

In one embodiment, a hydraulic device in the form of a rotary fluid pump-motor includes a first rotor assembly, a second rotor assembly, and a bent cylinder sleeve.

The first rotor assembly includes a first rotor, a piston cylinder, and a flange ring. The first rotor is rotatably movable about a first rotor axis with respect to the flange ring. The first rotor defines a bore therethrough. The piston cylinder is mounted to the first rotor and extends therefrom along the first rotor axis to a distal cylinder end. The piston cylinder is hollow and defines an interior cylinder cavity with a proximal opening and a distal opening. The interior cylinder cavity is in fluid communication with the bore of the first rotor via the proximal opening. The flange ring includes an inner perimeter defining an inner opening and an inclined guide surface circumscribing the perimeter. The piston cylinder is disposed within the inner opening of the flange ring. The second rotor assembly includes a second rotor and a piston. The second rotor is rotatably movable about a second rotor axis which is inclined relative to the first rotor axis such that the second rotor axis is in non-parallel relationship with the first rotor axis. The piston is mounted to the second rotor and extends therefrom along the second rotor axis to a distal piston end.

The bent cylinder sleeve includes a first sleeve segment with a first sleeve end defining a first sleeve opening and a second sleeve segment with a second sleeve end defining a second sleeve opening. The first and second sleeve segments respectively extend along the first and second rotor axes. The bent cylinder sleeve is hollow and defines an interior sleeve cavity in communication with the first sleeve opening and the second sleeve opening.

The piston cylinder extends through the first sleeve opening such that the distal cylinder end of the piston cylinder is disposed within the first sleeve segment. The piston extends through the second sleeve opening such that the distal piston end of the piston is disposed within the second sleeve segment. The piston cylinder, the bent cylinder sleeve, and the piston define a piston chamber therebetween. The bent cylinder sleeve thereby rotatively couples the first rotor and the second rotor.

The first sleeve end of the bent cylinder sleeve is in at least intermittent contacting relationship with the inclined guide surface of the flange ring of the first rotor assembly. The bent cylinder sleeve is rotatably movable about the first rotor axis with respect to the inclined guide surface. The inclined guide surface is configured such that the position of the first sleeve end of the bent cylinder sleeve along the first rotor axis relative to the piston cylinder varies based upon the circumferential position of the bent cylinder sleeve relative to the inclined guide surface to correspondingly vary the volume of the piston chamber.

In another embodiment, a rotary fluid pump-motor includes a first rotor assembly, a second rotor assembly, and a plurality of bent cylinder sleeves. The first rotor assembly includes a first rotor and a plurality of piston cylinders. The first rotor is rotatably movable about a first rotor axis. The piston cylinders are mounted to the first rotor about the first rotor axis in circumferential spaced relationship to each other. Each of the piston cylinders extends from the first rotor along the first rotor axis to a distal cylinder end. Each piston cylinder is hollow and defines an interior cylinder cavity with a distal opening at the distal cylinder end.

The second rotor assembly includes a second rotor and a plurality of pistons corresponding to the plurality of piston cylinders. The second rotor is rotatably movable about a second rotor axis. The second rotor axis is inclined relative to the first rotor axis such that the second rotor axis is in non-parallel relationship with the first rotor axis. The pistons are mounted to the second rotor about the second rotor axis in circumferential spaced relationship to each other. Each of the pistons extends from the second rotor along the second rotor axis to a distal piston end.

The plurality of bent cylinder sleeves corresponds to the piston cylinders and the pistons. Each bent cylinder sleeve is hollow and defines an interior sleeve cavity with a first sleeve opening and a second sleeve opening. Each bent cylinder sleeve has an exterior surface with a sidewall surface and a land surface projecting radially outwardly from the sidewall surface. The bent cylinder sleeves are rotatively coupled with a respective one of the piston cylinders and one of the pistons by receiving therein said one of the piston cylinders through the first sleeve opening and said one of the pistons through the second sleeve opening. The bent cylinder sleeves are circumferentially arranged with respect to each other such that the land surface of each bent cylinder sleeve is in contacting relationship with the land surface of at least one adjacent bent cylinder sleeve.

In still another embodiment, a rotary fluid pump-motor includes a first rotor assembly, a second rotor assembly, and a bent cylinder sleeve. The first rotor assembly includes a first rotor, a piston cylinder, and a flange ring. The first rotor is rotatably movable about a first rotor axis with respect to the flange ring. The piston cylinder is mounted to the first rotor and extends therefrom along the first rotor axis. The piston cylinder is hollow and defines an interior cylinder cavity with a proximal opening and a distal opening. The flange ring includes an inclined guide surface and an inner perimeter defining an inner opening. The piston cylinder is disposed within the inner opening of the flange ring. The inclined guide surface is a closed loop circumscribing the perimeter and is inclined such that a distance along the first rotor axis between the inclined guide surface and the proximal opening of the piston cylinder varies along the circumference of the inclined guide surface.

The second rotor assembly includes a second rotor and a piston. The second rotor is rotatably movable about a second rotor axis. The second rotor axis is inclined relative to the first rotor axis such that the second rotor axis is in non-parallel relationship with the first rotor axis. The piston is mounted to the second rotor and extends therefrom along the second rotor axis.

The bent cylinder sleeve is hollow and defines an interior sleeve cavity with first and second sleeve openings. The bent cylinder sleeve is rotatively coupled with the piston cylinder and the piston by receiving therein said piston cylinder through the first sleeve opening and the piston through the second sleeve opening. The interior sleeve cavity is in fluid communication with the interior cylinder cavity. The piston cylinder, the bent cylinder sleeve, and the piston define a piston chamber therebetween. The bent cylinder sleeve is in at least intermittent contacting relationship with the inclined guide surface of the flange ring. The bent cylinder sleeve is rotatably movable about the first rotor axis with respect to the inclined guide surface such that the bent cylinder sleeve moves along the first rotor axis relative to the piston cylinder based upon the circumferential position of the bent cylinder sleeve along the inclined guide surface to correspondingly vary the volume of the piston chamber.

Further and alternative aspects and features of the disclosed principles will be appreciated from the following detailed descriptions and the accompanying drawings. As will be appreciated, the principles relating to hydraulic devices disclosed herein are capable of being carried out in other and different embodiments, and are capable of being modified in various respects. Accordingly, it is to be understood that the foregoing general description and the following detailed description are exemplary and explanatory only and do not restrict the scope of the appended claims.

Figure 1:
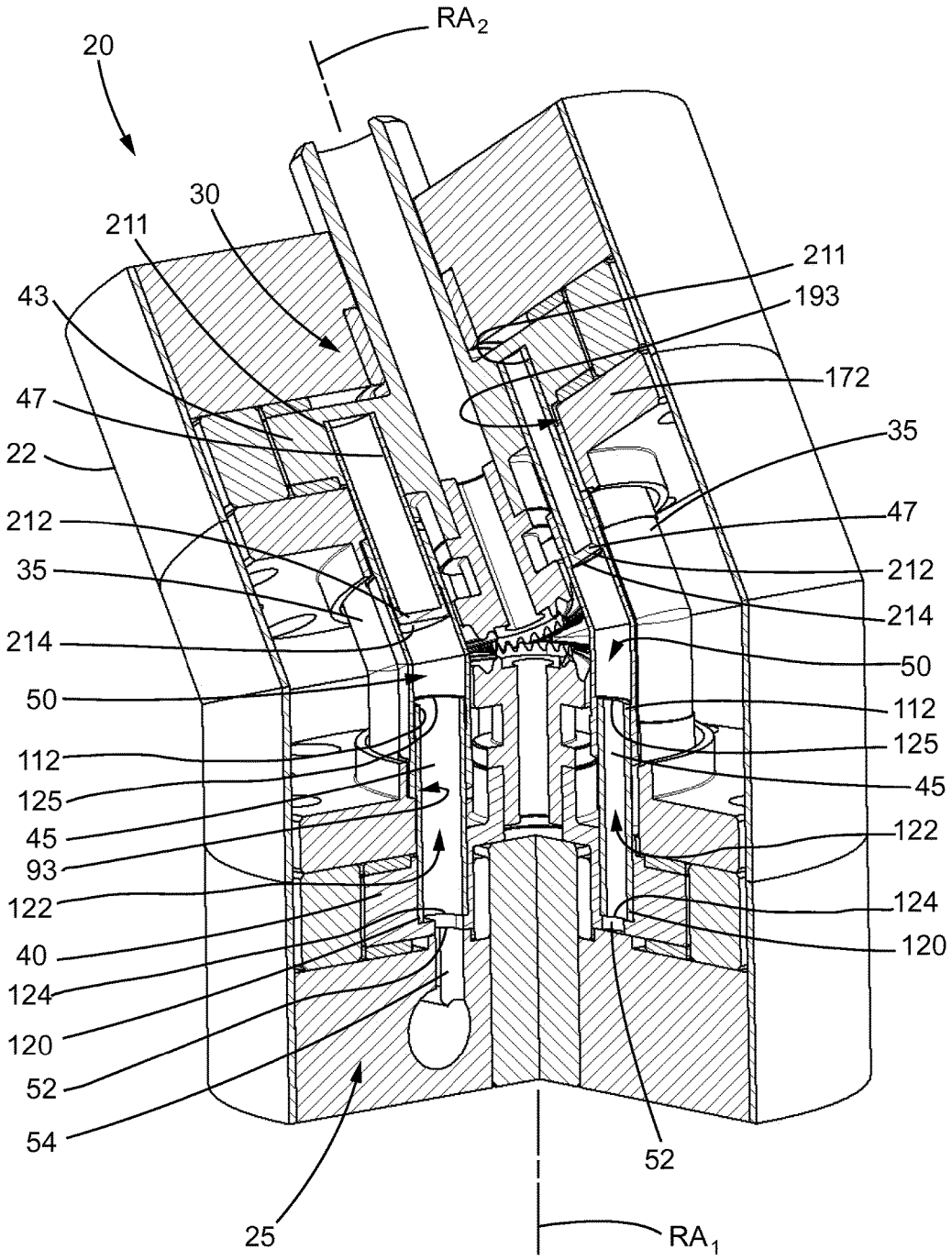
FIG. 1 is a perspective view, in partial section along a first rotor axis and along a second rotor axis, of an embodiment of a rotary fluid device in the form of a rotary fluid pump-motor constructed in accordance with principles of the present disclosure.

It should be understood that the drawings are not necessarily to scale and that the disclosed embodiments are sometimes illustrated diagrammatically and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION OF EMBODIMENTS

The present disclosure is directed to embodiments of a hydraulic device. In embodiments, a hydraulic device constructed following principles of the present disclosure is in the form of a rotary fluid pump-motor that can be configured to operate as a pump and/or as a motor. In embodiments, a rotary fluid device in the form of a rotary fluid pump-motor includes first and second rotors in which pistons mounted to at least one of which move in reciprocating fashion relative to working fluids. In embodiments, a hydraulic device in the form of a rotary fluid pump-motor according to principles of the present disclosure includes a first rotor assembly, a second rotor assembly, and a plurality of bent cylinder sleeves.

In embodiments, the first rotor assembly includes a first rotor and a plurality of piston cylinders. The first rotor is rotatably movable about a first rotor axis. The piston cylinders are mounted to the first rotor about the first rotor axis in circumferential spaced relationship to each other. Each of the piston cylinders extends from the first rotor along the first rotor axis to a distal cylinder end. Each piston cylinder is hollow and defines an interior cylinder cavity with a distal opening at the distal cylinder end.

In embodiments, the second rotor assembly includes a second rotor and a plurality of pistons corresponding to the plurality of piston cylinders. The second rotor is rotatably movable about a second rotor axis. The second rotor axis is inclined relative to the first rotor axis such that the second rotor axis is in non-parallel relationship with the first rotor axis. The pistons are mounted to the second rotor about the second rotor axis in circumferential spaced relationship to each other. Each of the pistons extends from the second rotor along the second rotor axis to a distal piston end.

In embodiments, the plurality of bent cylinder sleeves corresponds to the piston cylinders and the pistons. Each bent cylinder sleeve is hollow and defines an interior sleeve cavity with a first sleeve opening and a second sleeve opening. Each bent cylinder sleeve has an exterior surface with a sidewall surface and a land surface projecting radially outwardly from the sidewall surface. The bent cylinder sleeves are rotatively coupled with a respective one of the piston cylinders and one of the pistons by receiving therein said one of the piston cylinders through the first sleeve opening and said one of the pistons through the second sleeve opening. The bent cylinder sleeves are circumferentially arranged with respect to each other such that the land surface of each bent cylinder sleeve is in contacting relationship with the land surface of at least one adjacent bent cylinder sleeve.

In embodiments, the first and second rotor assemblies include first and second flange rings, respectively. The first and second rotors are rotatably movable about the first and second rotor axes with respect to the first and second flange rings, respectively. The first and second flange rings each includes an inner perimeter defining an inner opening and an inclined guide surface circumscribing the respective perimeter. Each of the bent cylinder sleeves includes a first sleeve end and a second sleeve end. The first and second sleeve ends of each bent cylinder sleeve are in at least intermittent contacting relationship with the inclined guide surface of the first and second flange rings, respectively. The bent cylinder sleeves are rotatably movable about the first and second rotor axes with respect to the inclined guide surface of the first and second flange rings, respectively. The inclined guide surfaces of the first and second flange rings are configured such that the position of the first and second sleeve ends of each bent cylinder sleeve along the first and second rotor axes relative to the respective piston cylinder and piston with which the first and second sleeve ends are associated varies based upon the circumferential position of the bent cylinder sleeve relative to the inclined guide surfaces to correspondingly vary the volume of the piston chamber.

In embodiments, a rotary fluid pump-motor constructed according to principles of the present disclosure can be configured to operate in pump mode to convert mechanical energy into hydraulic pressure. In embodiments, the first rotor assembly includes a port plate that defines a first fluid passage and a second fluid passage that is fluidly isolated from the first fluid passage. The first rotor is rotatably movable about the first rotor axis with respect to the port plate such that the bore of the first rotor is in periodic cyclical fluid communication with the first fluid passage and the second fluid passage based upon movement of the first rotor about the first rotor axis with respect to the port plate. In embodiments, the pistons pull fluid into the respective piston chambers (as the volume of the piston chambers increases) during half a revolution when they are in communication with the first fluid passage and push fluid out under pressure (as the volume of the piston chambers decreases) during the other half of the revolution when they are in communication with the second fluid passage. In motor mode, the rotary fluid pump-motor converts hydraulic pressure into torque and angular displacement of a shaft. The rotary fluid pump-motor operates in motor mode in a similar, but reverse, fashion as it does in pump mode.

In embodiments, the working fluid can be a variety of suitable fluids, such as air, hydraulic oil, or liquid fuel, for example. Embodiments of a rotary fluid pump-motor constructed according to principles of the present disclosure can advantageously provide a robust construction that can operate efficiently using a working fluid other than hydraulic oil, such as a liquid fuel, for example, and yet can be relatively easy to manufacture.

Turning now to the FIGURES, there is shown in FIG. 1 an exemplary embodiment of a rotary fluid device in the form of a rotary fluid pump-motor 20 constructed according to principles of the present disclosure. In embodiments, the rotary fluid pump-motor 20 can be configured as a fluid pump that is mechanically driven to produce a flow of pressurized fluid. The rotary fluid pump-motor 20 can also be configured as a fluid motor that receives a flow of pressurized fluid and responsively produces a mechanical output. The illustrated rotary fluid pump-motor 20 includes an enclosure 22, a first rotor assembly 25, a second rotor assembly 30, and a plurality of bent cylinder sleeves 35.

The first and second rotor assemblies 25, 30 have a first rotor 40 and a second rotor 43, respectively, mounted for rotation about coplanar axes set at an inclined angle with respect to each other. In embodiments, the inclined angle is in a range between ninety degrees and less than one hundred and eighty degrees. A plurality of piston cylinders 45 of the first rotor assembly 25 is respectively connected to a corresponding plurality of pistons 47 of the second rotor assembly 30 by the bent cylinder sleeves 35 to define a piston chamber 50 therebetween which has a variable working volume. Each cylinder sleeve 35 is bent at an intermediate segment to the same angle as the inclined angle between the rotor axes.

The piston cylinders 45 of the first rotor assembly 25 are in fluid communication with corresponding bores 52 defined in the first rotor 40. Working fluid is selectively admitted to the working volume of each piston chamber 50 via the bores 52 in the first rotor 40. On rotation of the first and second rotors 40, 43, the pistons 47 of the second rotor assembly 30 reciprocate relative to the piston cylinders 45 and the bent cylinder sleeves 35 with which they are respectively associated to vary the working volume within the interior piston chamber 50 defined therebetween. The volume between the piston 47 and a particular bore 52 with which it is associated effectively constitutes the working volume of the piston chamber 50 which varies cyclically as the first and second rotors 40, 43 rotate. The bores 52 of the first rotor 40 can be placed in selective fluid communication with other fluid passages 54 according to the configuration of the rotary fluid pump-motor 20 as a pump or a motor.

In the illustrated embodiment, the first and second rotor assemblies 25, 30 and the bent cylinder sleeves 35 are housed within the enclosure 22. The illustrated enclosure 22 comprises a hollow shell configured to house the other components of the rotary fluid pump-motor 20 therein. In embodiments, the enclosure can be made from any suitable material, such as a suitable metal, for example. In embodiments, the enclosure 22 can have a different shape and/or configuration. In embodiments, the enclosure 22 can be filled with a medium, such as a lubricant.

Figure 2:
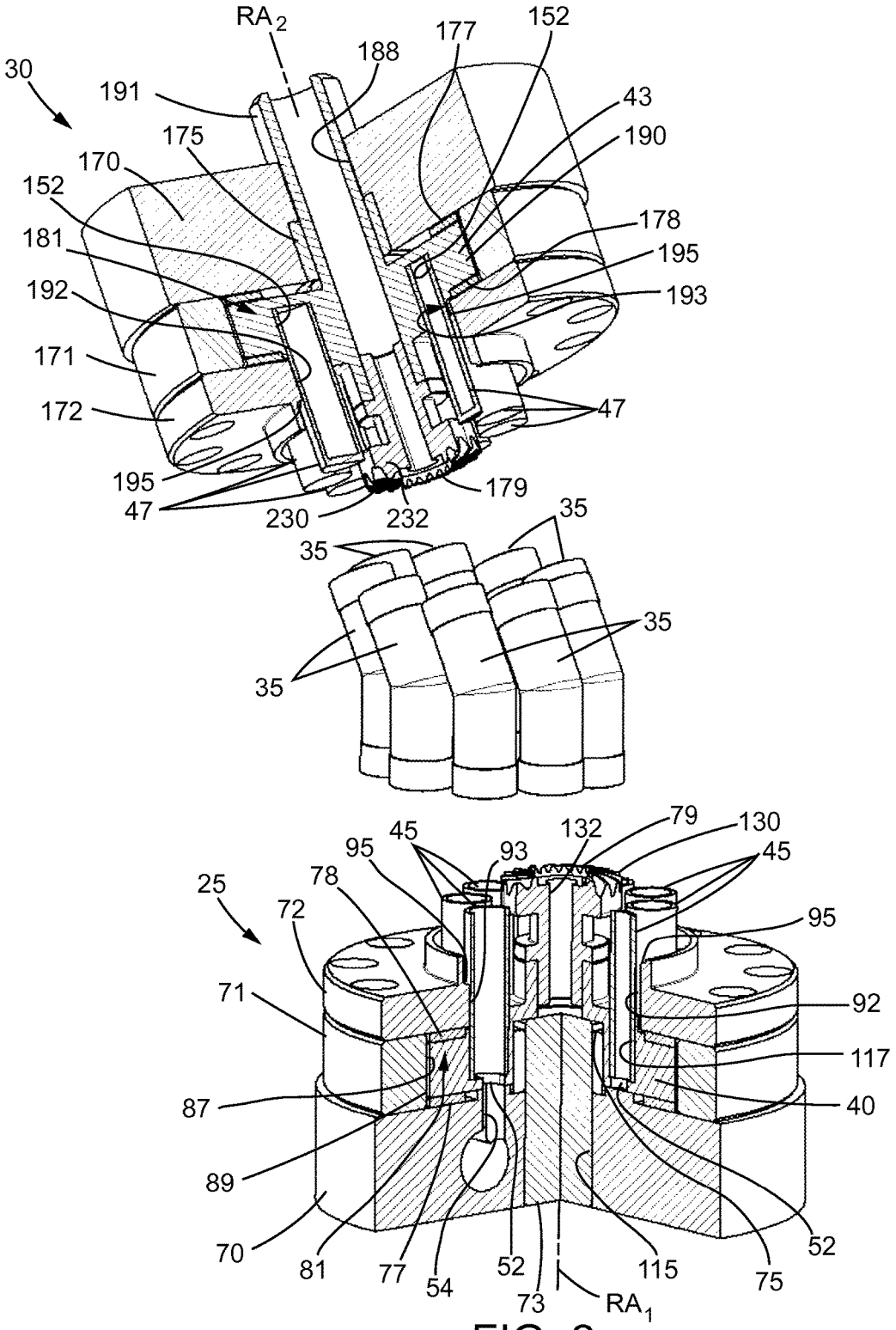
FIG. 2 is a partially exploded view of the rotary fluid pump-motor of FIG. 1.
Figure 3:
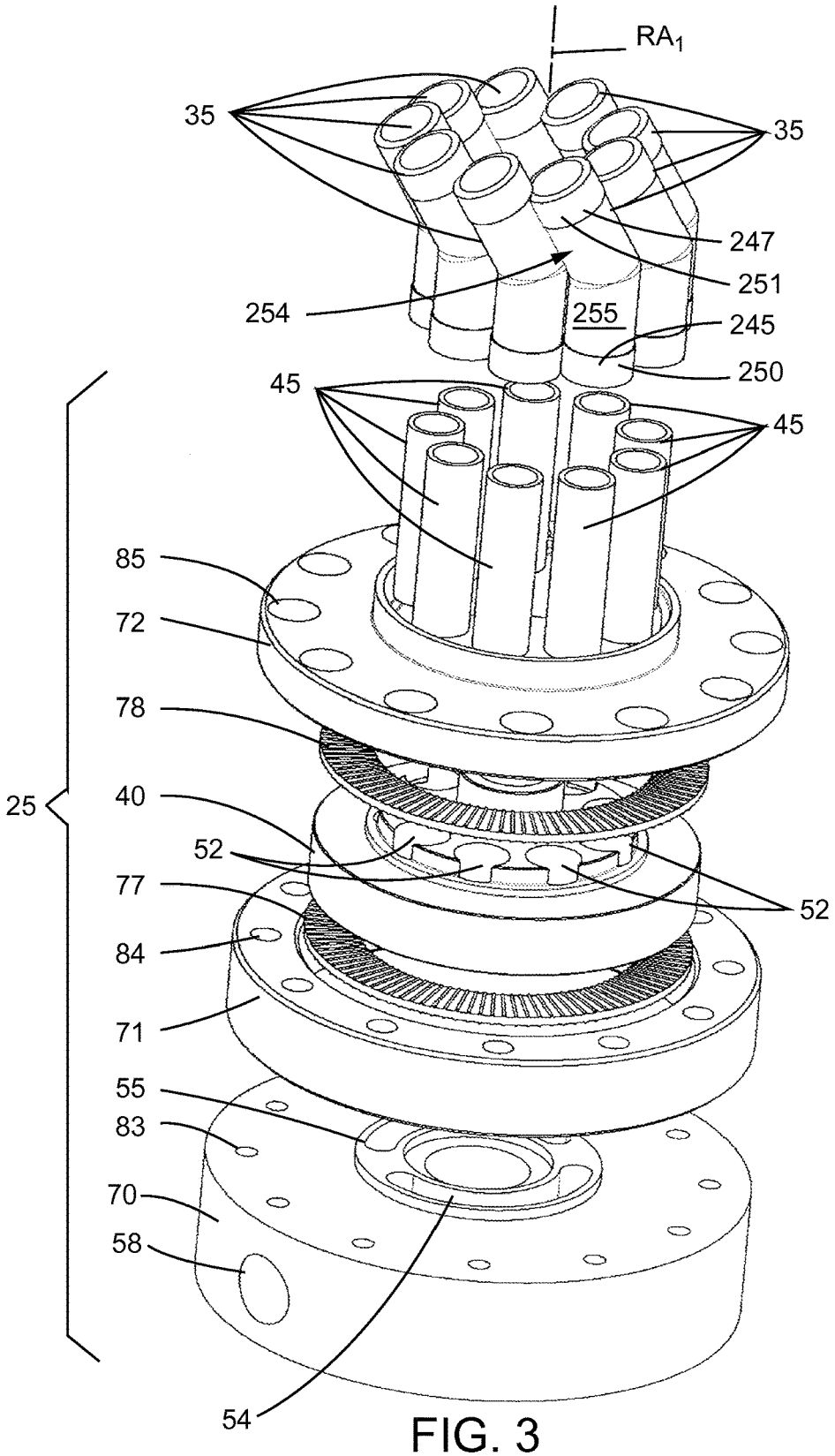
FIG. 3 is an exploded view of a first rotor assembly and a plurality of bent cylinder sleeves of the rotary fluid pump-motor of FIG. 1.

Referring to FIGS. 2 and 3, the illustrated first rotor assembly 25 includes a port plate 70, a first spacer ring 71, a first flange ring 72, a stub shaft 73, the first rotor 40, a roller element bearing 75, a pair of thrust bearings 77, 78, the plurality of piston cylinders 45, and a first gear shaft 79. In embodiments, the components of the first rotor assembly 25 can be made from any suitable material as will be appreciated by one skilled in the art, such as, a suitable metal, for example.

Referring to FIG. 2, the port plate 70, the first spacer ring 71, and the first flange ring 72 are connected together and cooperate to define a first rotor cavity 81 within which the first rotor 40 is disposed. In embodiments, any suitable connection technique can be used to secure the port plate 70, the first spacer ring 71, and the first flange ring 72 together, such as threaded fasteners through respective, aligned mounting bores 83, 84, 85 (see FIG. 3).

Referring to FIG. 2, the stub shaft 73 is fixedly mounted to the port plate 70 and extends into the first rotor cavity 81. The first rotor 40 is rotatably mounted to the stub shaft 73 such that the first rotor 40 is rotatable about a first rotor axis $RA_1$. The rolling element bearing 75 is interposed between the first rotor 40 and the stub shaft 73 and is configured to facilitate the rotational movement of the first rotor 40 with respect to the stub shaft 73 about the first rotor axis $RA_1$. The first rotor 40 is interposed between the pair of thrust bearings 77, 78 such that the thrust bearings 77, 78 facilitate the rotational movement of the first rotor 40 about the first rotor axis $RA_1$ relative to the port plate 70, the first spacer ring 71, and the first flange ring 72. In embodiments, the thrust bearings 77, 78 help maintain the first rotor 40 in spaced axial relationship along the first rotor axis $RA_1$ with respect to the interior surfaces of the port plate 70 and the first flange ring 72.

In embodiments, one or more of the bearings 75, 77, 78 can have a different form. For example, in embodiments, the bearings 75, 77, 78 can be of any suitable type known to one skilled in the art, such as, plain, hydrodynamic, hydrostatic, ball, taper roller, spherical roller, needle roller, etc.

The piston cylinders 45 and the first gear shaft 79 are fixedly mounted to the first rotor 40 such that the piston cylinders 45 and the first gear shaft 79 rotate about the first rotor axis $RA_1$ along with the rotation of the first rotor 40. The piston cylinders 45 and the first gear shaft 79 project from the first flange ring 72 toward the second rotor assembly 30.

Referring to FIG. 3, the port plate 70 defines first and second fluid passages 54, 55. The second fluid passage 55 is fluidly isolated from the first fluid passage 54. In embodiments, the port plate 70 can define a pair of connection ports 58 (one of which being shown in FIG. 3) in fluid communication with the first and second fluid passages 54, 55, respectively. In embodiments, the port plate 70 can have any suitable configuration known to one skilled in the art. For example, in embodiments, the port plate 70 can have a construction in the form of a floating port plate as will be understood by one skilled in the art.

The first spacer ring 71 is annular. The first spacer ring 71 is configured such that its interior sidewall surface 87 has a larger diameter than an outer sidewall 89 of the first rotor 40 such that there is a radial clearance therebetween (see FIG. 2). In embodiments, the size and/or shape of the first spacer ring 71 can be adjusted to correspondingly vary the size and/or shape of the first rotor cavity 81 to accommodate the first rotor 40 therein. In embodiments, the first spacer ring 71 can be integral with the port plate 70 or the first flange ring 72.

Figure 5:
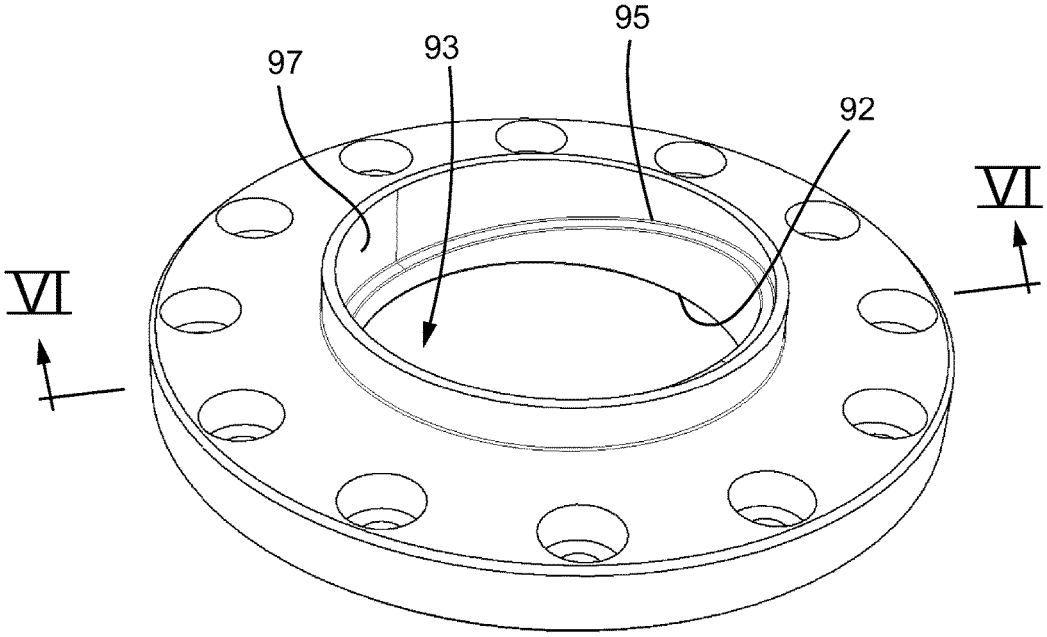
FIG. 5 is a perspective view of a flange ring of the rotary fluid pump-motor of FIG. 1, the flange ring including a centering ledge in the form of an inclined guide surface.

Referring to FIGS. 2 and 5, the first flange ring 72 includes an inner perimeter 92 defining an inner opening 93 and an inclined guide surface 95 circumscribing the inner perimeter 92. The inner opening 93 is configured to accommodate the piston cylinders 45 and the first gear shaft 79 such that these components extend through the inner opening 93 of the first flange ring 72. The inclined guide surface 95 is a closed loop circumscribing the inner perimeter 92.

In the illustrated embodiment, the first flange ring 72 includes an inner sidewall 97 extending axially along the first rotor axis $RA_1$ from the inner perimeter 92. The inner sidewall 97 includes the inclined guide surface and can be configured to help retain the bent cylinder sleeves 35 within inner opening 93 of the first flange ring 72. The bent cylinder sleeves can be constrained from moving radially outward relative to the first flange ring 72 via the interaction between each bent cylinder sleeve 35 and the inner sidewall 97 of the first flange ring 72.

Figure 6:
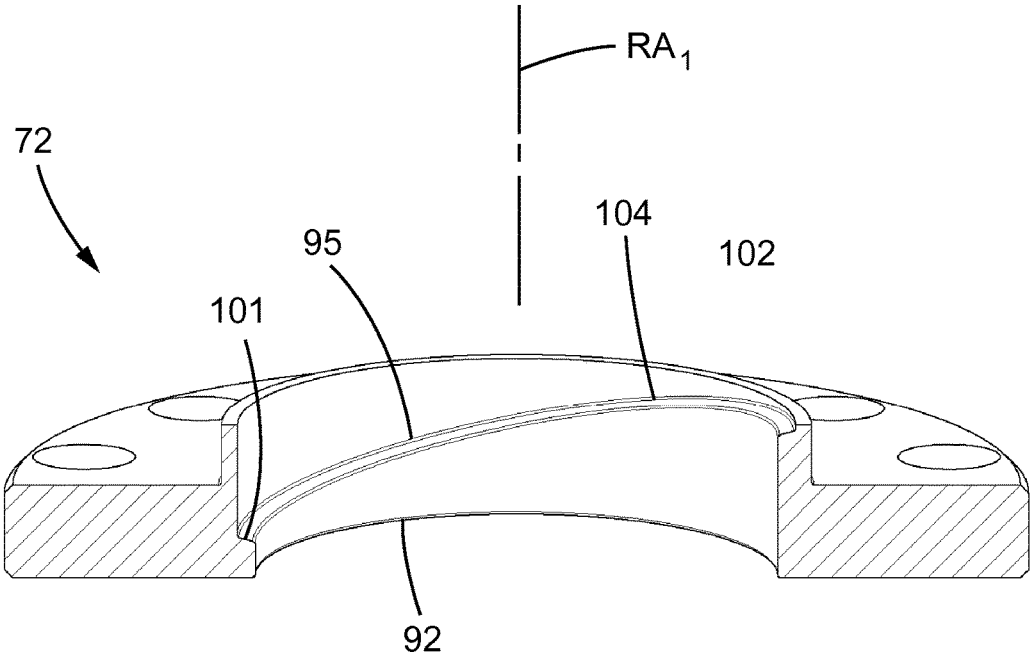
FIG. 6 is a cross-sectional view of the flange ring of FIG. 6 taken along line VI-VI in FIG. 6.
Figure 9:
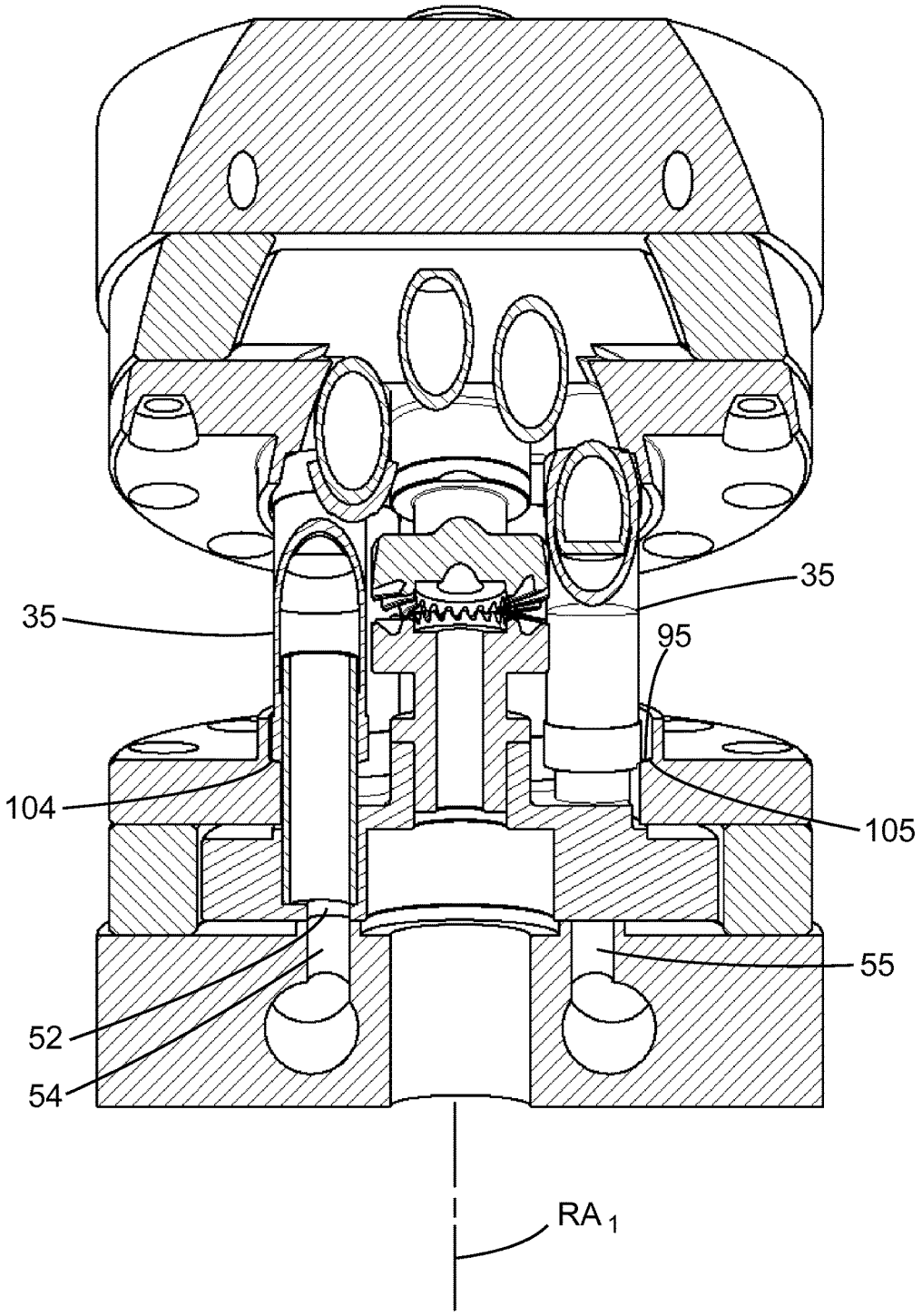
FIG. 9 is a longitudinal cross-sectional view along a plane including the first rotor axis of the rotary fluid pump-motor of FIG. 1, illustrating a pair of cylinders at intermediate locations between the first and second dead center locations, respectively.

Referring to FIG. 6, the inclined guide surface 95 of the first flange ring 72 includes a first dead center position 101 and a second dead center position 102 in axial offset relationship to the first dead center position 101 along the first rotor axis $RA_1$. The first and second dead center positions 101, 102 are in circumferential opposing relationship to each other about the inner perimeter 92 and are positioned one hundred eighty degrees apart from each other about the inner perimeter 92. The inclined guide surface 95 includes a pair of ramp segments 104 extending circumferentially between the first dead center position 101 and the second dead center position 102, one of which being shown in FIG. 6. The other ramp segment 105 is a mirror image of the one shown in FIG. 6 with respect to the first and second dead center positions 101, 102 (see FIG. 9 also). As shown in FIG. 9, the illustrated inclined guide surface 95 is configured such that, at a circumferential position between the first and second dead center positions 101, 102, the first and second ramp segments 104, 105 have the same relative axial position along the first rotor axis $RA_1$.

Figure 7:
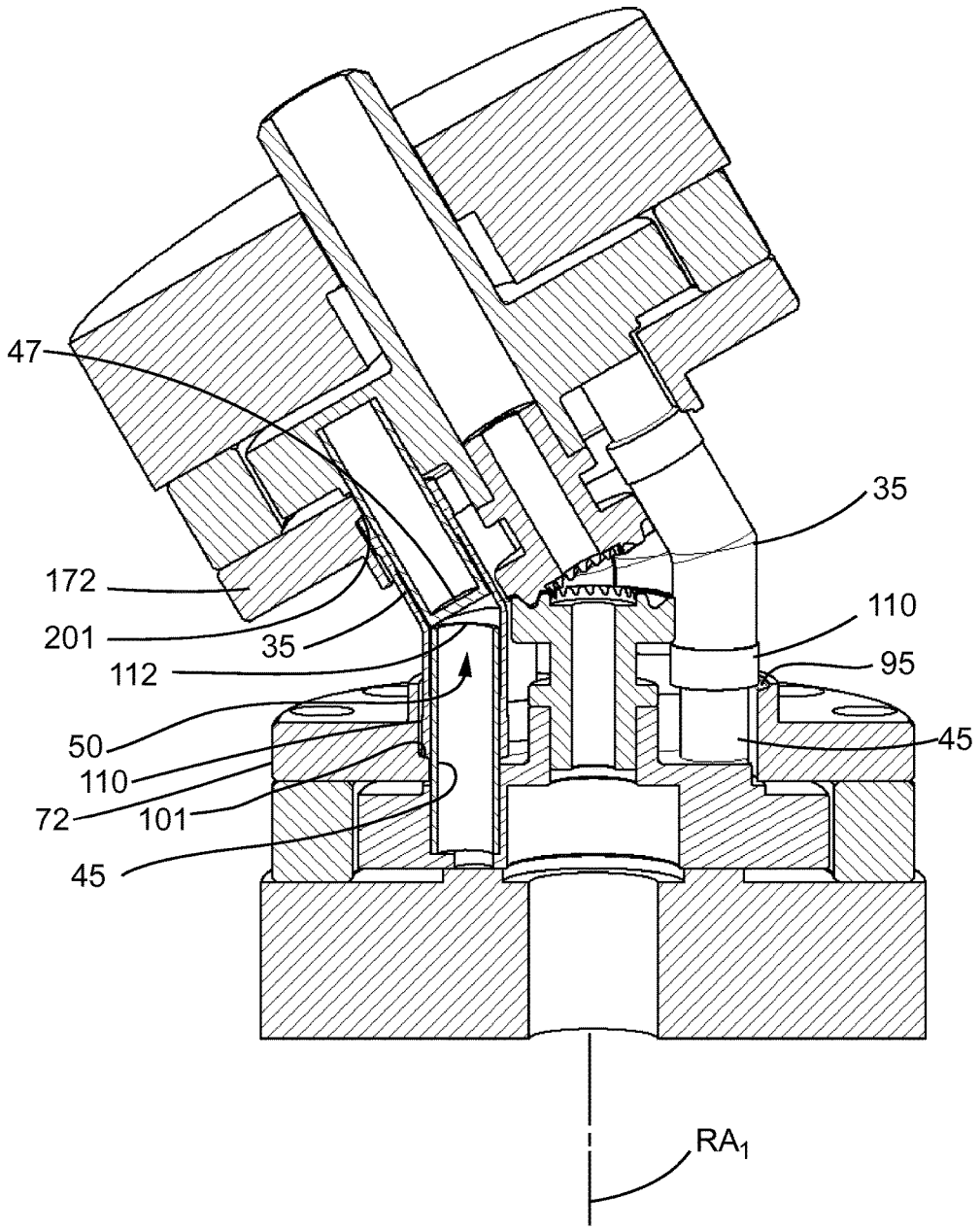
FIG. 7 is a longitudinal cross-sectional view of the rotary fluid pump-motor of FIG. 1 long a plane including both of first and second rotor axes, illustrating a pair of bent cylinder sleeves at first and second dead center locations, respectively, the bent cylinder sleeve at a first dead center location being in longitudinal section.
Figure 8:
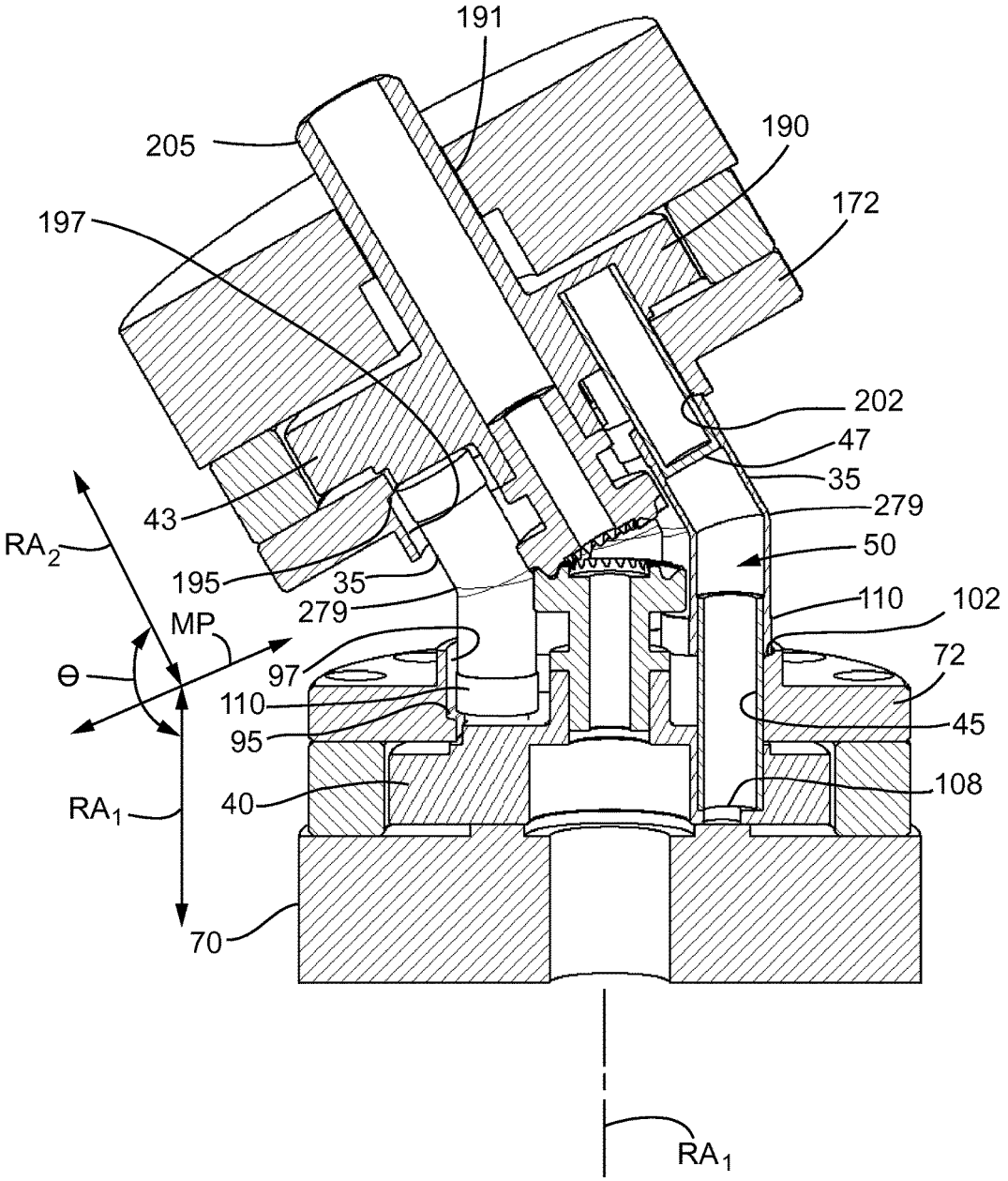
FIG. 8 is a view as in FIG. 7 of the rotary fluid pump-motor of FIG. 1, but illustrating the bent cylinder sleeve at a second dead center location in longitudinal section.

Referring to FIGS. 6-8, the inclined guide surface 95 is inclined such that a distance along the first rotor axis $RA_1$ between the inclined guide surface 95 and a proximal opening 108 of the piston cylinder 45 varies along the circumference of the inclined guide surface 95. Referring to FIGS. 7 and 8, the inclined guide surface 95 is configured such that a first sleeve end 110 of each bent cylinder sleeve 35 is reciprocally movable along the first rotor axis $RA_1$ relative to the piston cylinder 45 over a range of travel between a minimum volume position and a maximum volume position over each revolution of the bent cylinder sleeve 35 around the inclined guide surface 95.

In FIG. 7, the bent cylinder sleeve 35 shown in section is positioned at the first dead center position 101 of the inclined guide surface 95. When the piston cylinder 45 and its associated bent cylinder sleeve 35 are positioned at the first dead center position 101, the associated piston 47 is at its closest position relative to the piston cylinder 45. As shown in FIG. 7, the piston 47 is in close proximity to a distal cylinder end 112 of the piston cylinder 45. The position when the piston 47 of a particular piston-bent cylinder sleeve-piston cylinder arrangement is at its minimum distance apart from (or closest to) the piston cylinder 45, which is shown in section in FIG. 7, corresponds to the position where the volume defined by them within the bent cylinder sleeve 35 and the piston cylinder 45 is at a minimum and correlates to a top dead center position in a conventional reciprocating piston motor.

In FIG. 8, the bent cylinder sleeve 35 shown in section is positioned at the second dead center position 102. When the piston cylinder 45 and its associated bent cylinder sleeve 35 are positioned at the second dead center position 102, the associated piston 47 is at its farthest position relative to the piston cylinder 45. The position when the piston 47 of a particular piston-bent cylinder sleeve-piston cylinder arrangement is at its maximum distance apart from (or farthest from) the piston cylinder 45, which is shown in section in FIG. 8, corresponds to the position where the volume defined by them within the bent cylinder sleeve 35 and the piston cylinder 45 is at a maximum and correlates to a bottom dead center position in a conventional reciprocating piston motor.

Accordingly, in the illustrated embodiment, as each piston cylinder 45 rotates about the first rotor axis $RA_1$, the associated bent cylinder sleeve 35 and piston 47 cooperate together to vary the working volume of the piston chamber 50 from a minimum volume (shown in FIG. 7) to a maximum volume (once the piston cylinder rotates over one hundred eighty degrees of the inner perimeter and as shown in FIG. 8) and back to the minimum volume (upon returning to its original position shown in FIG. 7).

Referring to FIG. 2, the stub shaft 73 is generally cylindrical. In embodiments, the stub shaft 73 can be mounted to the port plate 70 using any suitable technique, such as, by being press fit into a central bore 115 defined within the port plate 70, for example. In embodiments, the stub shaft 73 can be integral with the port plate 70.

The first rotor 40 is rotatably movable about the first rotor axis $RA_1$ with respect to the port plate 70, the spacer ring 71, and the flange ring 72. The first rotor 40 defines the plurality of bores 52 therethrough corresponding to the number of piston cylinders 45 mounted thereto. Each piston cylinder 45 is associated with a respective one of the bores 52 defined through the first rotor 40. In the illustrated embodiment, each of the bores 52 includes a counterbore portion 117 configured to accept a respective one of the piston cylinders 45 therein such that the piston cylinder 45 is positively seated within the bore 52 at a shoulder defined by the bottom of each counterbore portion 117.

The first and second fluid passages 54, 55 of the port plate 70 are configured such that the bores 52 of the first rotor 40 are respectively in periodic cyclical fluid communication with the first fluid passage 54 and the second fluid passage 55 based upon movement of the first rotor 40 about the first rotor axis $RA_1$ with respect to the port plate 70 (see FIG. 3 also). In embodiments, each bore 52 of the first rotor 40 is in fluid communication with the first fluid passage 54 when the bore 52 and the bent cylinder sleeve 35 with which it is associated are positioned at the first dead center position 101 of the inclined guide surface 95 and with the second fluid passage 55 when the bore 52 and the bent cylinder sleeve 35 with which it is associated are positioned at the second dead center position 102 of the inclined guide surface 95. FIG. 9 shows two bent cylinder sleeves 35 in partial section which are both disposed intermediate of the first and second dead center positions. The bores 52 associated with those bent cylinder sleeves 35 are in respective fluid communication with the first and second fluid passages 54, 55.

Referring to FIG. 3, in the illustrated embodiment, the first rotor assembly 25 includes nine piston cylinders 45 and a corresponding nine bores 52 in the first rotor 40. The nine bores 52 are in substantially uniform, spaced circumferential relationship to each other about a pitch circle that is substantially concentric with the first rotor axis $RA_1$. The longitudinal axis of each bore 52 is substantially aligned with the first rotor axis $RA_1$.

In other embodiments, the number of piston cylinders 45, first rotor bores 52, and bent cylinder sleeves 35 can vary. In other embodiments, the spacing between at least one of the bores 52 and one other bore 52 can be different than the spacing of the other bores 52. In embodiments, the layout of the bores 52 relative to the first rotor axis $RA_1$ can be different.

In the illustrated embodiment, the piston cylinders 45 are substantially identical to each other. Accordingly, it will be understood that the description of one of the piston cylinders 45 is applicable to each of the other piston cylinders 45, as well.

Referring to FIG. 1, each of the piston cylinders 45 extends along the first rotor axis $RA_1$ from a proximal end 120 mounted to the first rotor 40 to the distal cylinder end 112. The piston cylinders 45 are mounted to the first rotor 40 about the first rotor axis $RA_1$ in circumferential spaced relationship to each other. The piston cylinders 45 are disposed within the inner opening 93 of the first flange ring 72. In embodiments, any suitable technique for fixedly mounting the piston cylinders 45 to the first rotor 40 can be used. For example, in embodiments, the piston cylinders 45 can be mounted to the first rotor 40 by being press fit thereto or by being manufactured as an integral piece of material.

Each piston cylinder 45 is hollow and defines an interior cylinder cavity 122 with a proximal opening 124 at the proximal end 120 and a distal opening 125 at the distal cylinder end 112. The interior cylinder cavity 122 of each piston cylinder 45 is in fluid communication via its proximal opening 124 with a respective one of the bores 52 defined through the first rotor 40. Accordingly, the interior cylinder cavity 122 of each piston cylinder 45 is respectively in periodic cyclical fluid communication with the first fluid passage 54 and the second fluid passage 55 (see FIG. 3) of the port plate 70 based upon the rotational movement of the first rotor 40 about the first rotor axis $RA_1$ with respect to the port plate 70.

Referring to FIG. 2, in the illustrated embodiment, the first rotor assembly 25 includes the first gear shaft 79 which is mounted to the first rotor 40. The first gear shaft 79 can be fixedly mounted to the first rotor 40 using any suitable technique, such as, by being press fit thereto. In embodiments, a splined connection can be used between the first gear shaft 79 and the first rotor 40 to further enhance the rotative coupling therebetween. The first gear shaft 79 extends along the first rotor axis $RA_1$ and includes a bevel gear 130 at its distal end 132. In embodiments, the first gear shaft 79 can be omitted.

Figure 4:
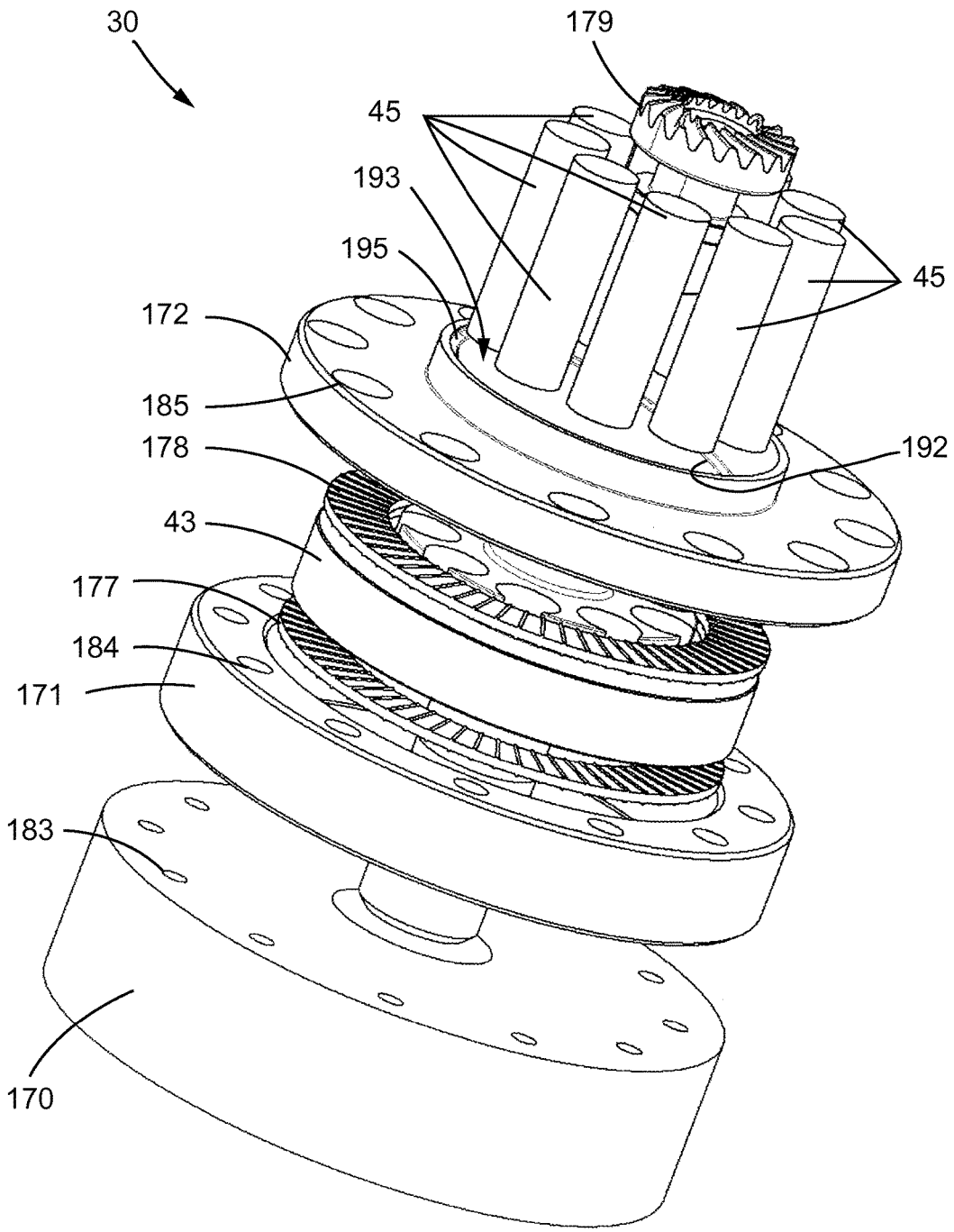
FIG. 4 is an exploded view of a second rotor assembly of the rotary fluid pump-motor of FIG. 1.

Referring to FIGS. 2 and 4, the illustrated second rotor assembly 30 includes a plate 170, a second spacer ring 171, a second flange ring 172, the second rotor 43, a roller element bearing 175, a pair of thrust bearings 177, 178, the plurality of pistons 47 corresponding to the number of piston cylinders 45, and a second gear shaft 179. In embodiments, the components of the second rotor assembly 30 can be made from any suitable material as will be appreciated by one skilled in the art, such as, a suitable metal, for example.

Referring to FIG. 2, the plate 170, the second spacer ring 171, and the second flange ring 172 are connected together and cooperate to define a second rotor cavity 181 within which the second rotor 43 is disposed. In embodiments, any suitable connection technique can be used to secure the plate 170, the second spacer ring 171, and the second flange ring 172 together, such as threaded fasteners through respective, aligned mounting bores 183, 184, 185 (see FIG. 4).

Referring to FIG. 2, the plate 170 defines a central passage 188 therethrough that is configured to accept the roller element bearing 175 therein. A plate portion 190 of the second rotor 43 is disposed within the second rotor cavity 181, and a shaft portion 191 of the second rotor 43 extends from the plate portion 190 through the central passage 188 of the plate 170. The second rotor 43 is rotatably mounted to the plate 170 such that the second rotor 43 is rotatable about a second rotor axis $RA_2$. The roller element bearing 175 is interposed between the second rotor 43 and the plate 170 and is configured to facilitate the rotational movement of the second rotor 43 with respect to the plate 170 about the second rotor axis $RA_2$.

The second rotor 43 is interposed between the pair of thrust bearings 177, 178 such that the thrust bearings 177, 178 facilitate the rotational movement of the second rotor 43 about the second rotor axis $RA_2$ relative to the plate 170, the second spacer ring 171, and the second flange 43. In embodiments, the thrust bearings 177, 178 help maintain the second rotor 43 in spaced relationship with respect to the interior surfaces of the plate 170 and the second flange ring 172 along the second rotor axis $RA_2$.

The pistons 47 and the second gear shaft 179 are fixedly mounted to the second rotor 43 such that the pistons 47 and the second gear shaft 179 rotate about the second rotor axis $RA_2$ along with the rotation of the second rotor 43. The pistons 47 and the second gear shaft 179 project from the second flange ring 172 toward the first rotor assembly 25.

Referring to FIG. 4, the plate 170 is generally in the form of a circular disc. In other embodiments, the plate 170 can have a different shape and/or size.

The second spacer ring 171 is annular. The second spacer ring 171 is configured such that there is a radial clearance between it and the second rotor 43. In embodiments, the size and/or shape of the second spacer ring 171 can be adjusted to correspondingly vary the size and/or shape of the second rotor cavity 181 to accommodate the second rotor 43 therein. In embodiments, the second spacer ring 171 can be integral with the plate 170 or the second flange ring 172. In the illustrated embodiment, the second spacer ring 171 is substantially identical to the first spacer ring 71. In other embodiments, the first and second spacer rings 71, 171 can be different from each other.

Referring to FIGS. 2 and 4, in the illustrated embodiment, the second flange ring 172 of the second rotor assembly 30 is substantially identical to the first flange ring 72 of the first rotor assembly 25. The second flange ring 172 includes an inner perimeter 192 defining an inner opening 193 and an inclined guide surface 195 circumscribing the inner perimeter 192. The inner opening 193 of the second flange ring 172 is configured to accommodate the pistons 47 and the second gear shaft 179 such that these components extend through the inner opening 193 of the second flange ring 172 toward the first rotor assembly 25. The inclined guide surface 195 of the second flange ring 172 is a closed loop circumscribing the inner perimeter 192. The inclined guide surface 195 of the second flange ring 172 is substantially identical to the inclined guide surface 95 of the first flange ring 72.

Referring to FIG. 7, in embodiments, the inclined guide surfaces 95, 195 of the first and second flange rings 72, 172 are substantially circumferentially aligned with each other such that, when each piston cylinder 45 and its associated bent cylinder sleeve 35 are positioned at the first dead center position 101 of the inclined guide surface 95 of the first flange ring 72, the associated piston 47 and the associated bent cylinder sleeve 35 are also positioned at the first dead center position 201 of the inclined guide surface 195 of the second flange ring 172. Referring to FIG. 8, in a similar manner, when the piston cylinder 45 and its associated bent cylinder sleeve 35 are positioned at the second dead center position 102 of the inclined guide surface 95 of the first flange ring 72, the associated piston 47 and the associated bent cylinder sleeve 35 are also positioned at the second dead center position 202 of the inclined guide surface 195 of the second flange ring 172.

In other embodiments, the inclined guide surfaces 95, 195 of the first and second flange rings 72, 172 can have a different relative relationship with respect to each other. In embodiments, the inclined guide surface 95, 195 of one of the first and second flange rings 72, 172 can be omitted or located on a stationary bent shaft that is internal to the assemblies rather than external thereto. In other embodiments, one or both of the inclined guide surfaces 95, 195 can be located on a different component. For example, in embodiments, one or both of the inclined guide surfaces 95, 195 can be located on a stationary bent shaft that runs internally to the sleeves. In such embodiments, the gear set can be omitted or positioned in a different location.

Referring to FIG. 2, the second rotor 43 is rotatably movable about the second rotor axis $RA_2$ with respect to the port 170, the second spacer ring 171, and the second flange ring 172. The second rotor 43 defines a plurality of blind passages 152 corresponding to the number of pistons 47 mounted thereto. In the illustrated embodiment, the plate portion 190 of the second rotor 43 defines the blind passages 152. Each piston 47 is associated with a respective one of the blind passages 152 defined in the second rotor 43. In the illustrated embodiment, the second rotor assembly 30 includes nine pistons 47 and a corresponding nine blind passages 152 in the second rotor 43. The nine blind passages 152 are in substantially uniform, spaced circumferential relationship to each other about a pitch circle that is substantially concentric with the second rotor axis $RA_2$. The longitudinal axis of each blind passage 152 is substantially aligned with the second rotor axis $RA_2$.

In other embodiments, the number of pistons 47, blind passages 152 in the second rotor 43, corresponding bent cylinder sleeves 35, and piston cylinders 45 can vary. In other embodiments, the spacing between at least one of the blind passages 152 and one other blind passage 152 can be different than the spacing of the other blind passages 152. In embodiments, the layout of the blind passages 152 relative to the second rotor axis $RA_2$ can be different.

Referring to FIG. 8, in the illustrated embodiment, the second rotor axis $RA_2$ is inclined relative to the first rotor axis $RA_1$ such that the second rotor axis $RA_2$ is in non-parallel relationship with the first rotor axis $RA_1$. The first and second rotor axes $RA_1$, $RA_2$ define an oblique angle $\theta$ therebetween. In embodiments, the first and second rotor axes $RA_1$, $RA_2$ are disposed in a common plane. In embodiments, the oblique angle $\theta$ defined between the first and second rotor axes $RA_1$, $RA_2$ can be in a range between greater than ninety degrees and less than one hundred eighty degrees. In other embodiments, the oblique angle θ defined between the first and second rotor axes $RA_1$, $RA_2$ can be in a range between about 120° to 150°. In embodiments, the oblique angle θ defined between the first and second rotor axes $RA_1$, $RA_2$ can be about 135°.

In embodiments, at least one of the first and second rotors 40, 43 is rotatively coupled to a shaft extending along the respective first and second rotor axes $RA_1$, $RA_2$. In the illustrated embodiment, the second rotor 43 includes the shaft portion 191 which is integral with the plate portion 190. The plate portion 190 extends radially from the shaft portion 191 such that the plate portion 190 is substantially perpendicular to the axial direction of the shaft portion 191. In embodiments, the plate portion 190 is fixedly connected with the shaft portion 191 of the second rotor 43 such that rotation of the shaft portion 191 causes the plate portion 190 to also rotate about the second rotor axis $RA_2$, which in turn causes the first rotor 40 to rotate. In other embodiments, the shaft portion 191 can be a separate component which is connected to the plate portion 190 using any suitable technique, such as, by welding, sintering, or other known metal joining processes. The shaft portion 191 is configured such that a terminal end 205 of the shaft portion 191 projects from the plate 170.

Referring to FIG. 2, the roller element bearing 175 encircles the shaft portion 191 of the second rotor 43 to support the rotation of the shaft portion 191 about the second rotor axis $RA_2$. In embodiments, a running seal can be provided between the shaft portion 191 and the plate 170 which permits relative rotation of the shaft portion 191 with respect to the plate 170 but helps prevent the entry of dirt and other contaminants into the central passage 188 of the plate 170. In embodiments, a motor can be rotatively coupled to the terminal end 205 of the shaft portion 191 to help configure the rotary fluid pump-motor 20 to operate as a pump. In other embodiments, a driven component can be rotatively coupled to the terminal end 205 of the shaft portion 191 that can be selectively driven by the rotary fluid pump-motor 20 when it operates in motor mode.

In the illustrated embodiment, the pistons 47 are substantially identical to each other. Accordingly, it will be understood that the description of one of the pistons 47 is applicable to each of the other pistons 47, as well.

Referring to FIG. 1, the pistons 47 are mounted to the second rotor 43 about the second rotor axis $RA_2$ in circumferential spaced relationship to each other. Each of the pistons 47 extends along the second rotor axis $RA_2$ from a proximal end 211 mounted to the second rotor 43 to a distal piston end 212. The pistons 47 are disposed within the inner opening 193 of the second flange ring 172. In embodiments, any suitable technique for fixedly mounting the pistons 47 to the second rotor 43 can be used. For example, in embodiments, the pistons 47 can be mounted to the second rotor 43 by being press fit thereto or they can be manufactured as integral parts of a single component.

The distal piston end 212 of each piston 47 includes closed piston face 214. The relative position of the closed piston face 214 with respect to the associated bent cylinder sleeve 35 and the piston cylinder 40 such that the working volume of the piston chamber 50 within the bent cylinder sleeve 35 and the piston cylinder 40 varies cyclically with the rotational movement of the piston 47 about the second rotor axis $RA_2$.

In embodiments, the first and second rotors 40, 43 each include a gear respectively projecting along the first and second rotor axes $RA_1$, $RA_2$. The gears can be in enmeshed relationship with each other to constrain the first and second rotors 40, 43 to rotate in phase with each other about the first and second rotor axes $RA_1$, $RA_2$, respectively.

Referring to FIG. 2, in the illustrated embodiment, the second gear shaft 179 is mounted to the second rotor 43 such that the second gear shaft 179 extends along the second axis $RA_2$. The second gear shaft 179 includes a bevel gear 230 at its distal end 232 which is configured to be enmeshed with the bevel gear 130 of the first gear shaft 79 to rotatively couple the first and second rotors 40, 43 together (see also, FIG. 10). The second gear shaft 179 can be fixedly mounted to the second rotor 43 using any suitable technique, such as, by being press fit thereto. In embodiments, the second gear shaft 179 can be substantially identical to the first gear shaft 79. In embodiments, the gear teeth of the first and second gear shafts 79, 179 can be configured to accommodate, and conform to, the inclined angle θ between the first and second rotor axes $RA_1$, $RA_2$.

Referring to FIGS. 2 and 3, the plurality of bent cylinder sleeves 35 corresponds to the piston cylinders 45 and the pistons 47. In the illustrated embodiment, the bent cylinder sleeves 35 are substantially identical to each other. Accordingly, it will be understood that the description of one of the bent cylinder sleeves 35 is applicable to each of the other bent cylinder sleeves 35, as well.

Figure 11:
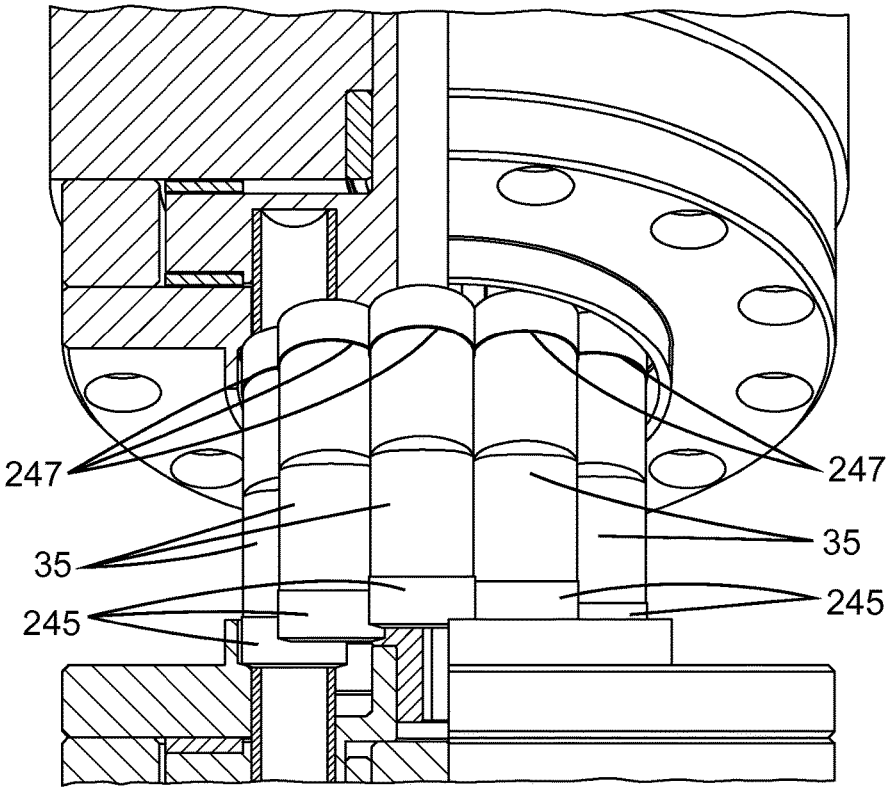
FIG. 11 is a fragmentary, enlarged view, partially in section, of the rotary fluid pump-motor of FIG. 1, illustrating the bent cylinder sleeves in engaging contact with each other.

Referring to FIG. 3, in embodiments, each bent cylinder sleeve 35 includes a land surface 245 disposed at one of a first sleeve end 250 and a second sleeve end 251 (only one of which being indicated in FIG. 3 for clarity purposes). In the illustrated embodiment, each bent cylinder sleeve 35 has an exterior surface 254 with a sidewall surface 255 and first and second land surfaces 245, 247 projecting radially outwardly from the sidewall surface 255. The first and second land surfaces 245, 247 are disposed respectively at the first and second sleeve ends 250, 251. The bent cylinder sleeves 35 are circumferentially arranged with respect to each other such that the first and second land surfaces 245, 247 of each bent cylinder sleeve 35 are in respective contacting relationship with the first and second land surfaces 245, 247 of a pair of adjacent bent cylinder sleeves 35 (see FIG. 11 also).

Figure 10:
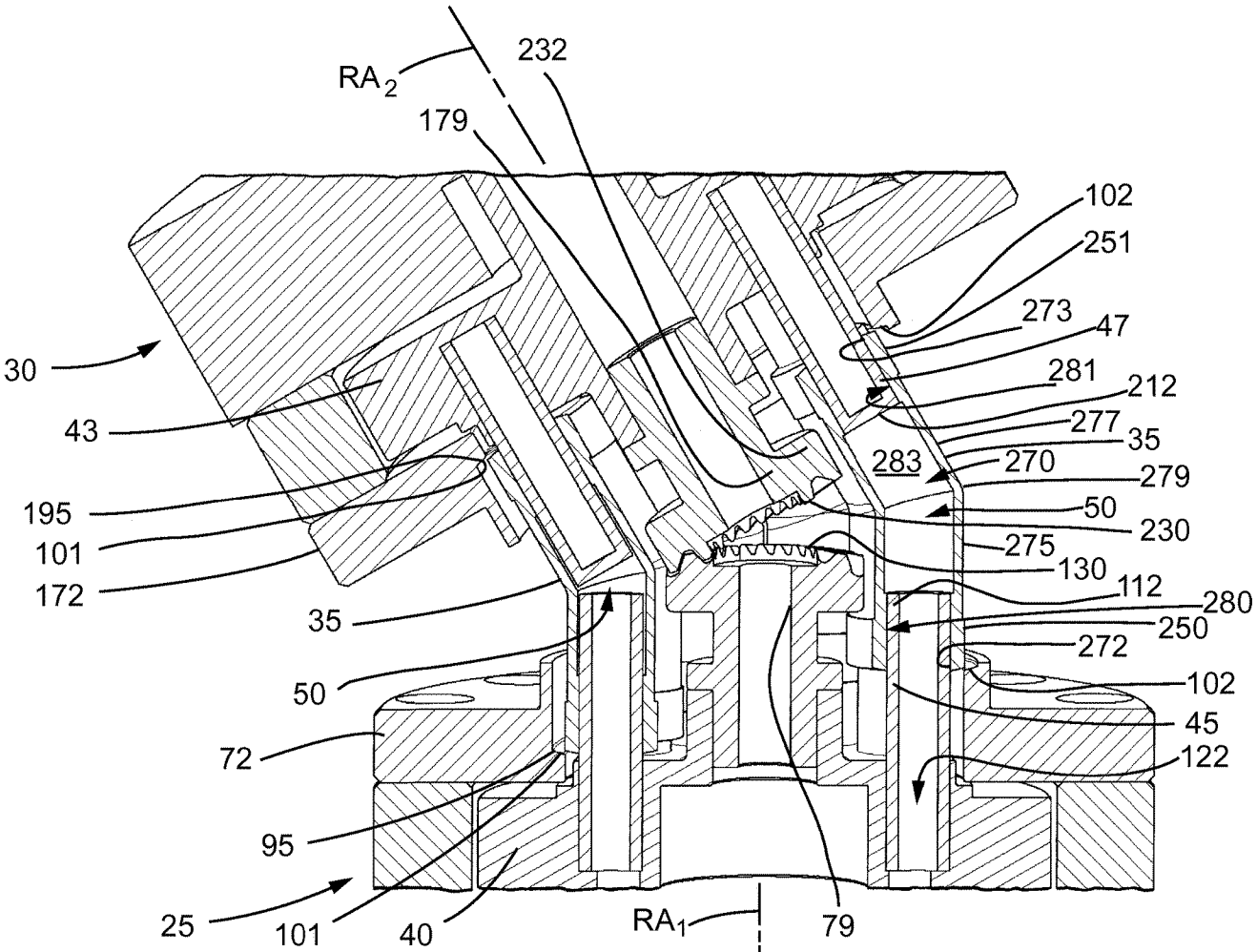
FIG. 10 is a fragmentary, enlarged detail view, taken from FIG. 7, of the rotary fluid pump-motor of FIG. 1, but illustrating both of the pair of bent cylinder sleeves in longitudinal section.

Referring to FIG. 10, each bent cylinder sleeve 35 is hollow and defines an interior sleeve cavity 270 with a first sleeve opening 272 and a second sleeve opening 273. Each bent cylinder sleeve 35 includes a first sleeve segment 275, which includes the first sleeve end 250 that in turn defines the first sleeve opening 272, and a second sleeve segment 277, which includes the second sleeve end 251 that defines the second sleeve opening 273. The first and second sleeve segments 275, 277 respectively extend along the first and second rotor axes $RA_1$, $RA_2$. The first and second sleeve segments 275, 277 of the bent cylinder sleeve 35 are connected together at an intermediate joint 279.

An interior sleeve end surface 280, 281 of both the first and second sleeve ends 250, 251 can project radially inward relative to an interior intermediate sleeve surface 283 such that the first and second interior sleeve end surfaces 280, 281 are in running sealing engagement with the associated piston cylinder 45 and piston 47, respectively, yet allowing relative rotational and axial movement therebetween. By relieving the interior intermediate sleeve surface 283 such that it is radially outward of the first and second interior sleeve end surfaces 280, 281, relative movement between the associated piston cylinder 45/piston 47 and the bent cylinder sleeve 35 is facilitated.

The bent cylinder sleeves 35 are rotatively coupled with a respective one of the piston cylinders 45 and one of the pistons 47 by receiving therein said one of the piston cylinders 45 through the first sleeve opening 272 and said one of the pistons 47 through the second sleeve opening 272. For each bent cylinder sleeve 35, the associated piston cylinder 45 extends through the first sleeve opening 272 such that the distal cylinder end 112 of the piston cylinder 45 is disposed within the first sleeve segment 275. In the illustrated embodiment, the distal cylinder end 112 of the piston cylinder 45 is in contacting engagement with the first interior sleeve end surface 280 over the entire revolution of the bent cylinder sleeve around the circumference of the inclined guide surface 95.

The associated piston 47 extends through the second sleeve opening 273 such that the distal piston end 212 of the piston 47 is disposed within the second sleeve segment 277. The bent cylinder sleeve 35 thereby rotatively couples the first rotor 40 and the second rotor 43. In the illustrated embodiment, the distal piston end 212 of the piston 47 is in contacting engagement with the second interior sleeve end surface 281 over the entire revolution of the bent cylinder sleeve 35 around the circumference of the inclined guide surface 95.

For each bent cylinder sleeve 35, the interior sleeve cavity 270 is in fluid communication with the interior cylinder cavity 122 of the piston cylinder 45 with which it is associated. Each respectively coupled piston cylinder 45, bent cylinder sleeve 35, and piston 47 defines the piston chamber 50 therebetween. The piston chamber 50 has a first volume when the bent cylinder sleeve 35 is positioned at the first dead center position 101 of the inclined guide surface 95 and a second volume when the bent cylinder sleeve 35 is positioned at the second dead center position 102 of the inclined guide surface 95. The second volume is greater than the first volume.

In embodiments, each bent cylinder sleeve 35 is in at least intermittent contacting relationship with the inclined guide surface 95 of at least one of the first and second flange rings 72, 172 limiting its axial movement along either piston. Each bent cylinder sleeve 35 is rotatably movable about the first rotor axis $RA_1$ with respect to the inclined guide surface 95 of the first flange ring 72 such that the bent cylinder sleeve 35 moves along the first rotor axis $RA_1$ relative to the piston cylinder 45 based upon the circumferential position of the respective bent cylinder sleeve 35 along the inclined guide surface 95 of the first flange ring 72 to correspondingly vary the volume of the piston chamber 50.

In the illustrated embodiment, the first sleeve end 250 of each bent cylinder sleeve 35 is in at least intermittent contacting relationship with the inclined guide surface 95 of the first flange ring 72 of the first rotor assembly 25. Each bent cylinder sleeve 35 is rotatably movable about the first rotor axis $RA_1$ with respect to the inclined guide surface 95 of the first flange ring 72. The inclined guide surface 95 of the first flange ring 72 is configured such that each bent cylinder sleeve 35 is movable along the first rotor axis $RA_1$ relative to the piston cylinder 45 with which it is associated based upon the circumferential position of the bent cylinder sleeve 35 relative to the inclined guide surface 95 of the first flange ring 72. The inclined guide surface 95 of the first flange ring 72 is configured such that the position of the first sleeve end 250 of each bent cylinder sleeve 35 along the first rotor axis $RA_1$ relative to the piston cylinder 45 with which it is associated varies based upon the circumferential position of the bent cylinder sleeve 35 relative to the inclined guide surface 95 to correspondingly vary the volume of the piston chamber 50 defined thereby.

The inclined guide surface 95 of the first flange ring 72 is configured such that each bent cylinder sleeve 35 moves along the first rotor axis $RA_1$ away from the piston cylinder 45 with which it is associated as the respective bent cylinder sleeve 35 moves in a direction of rotation about the first rotor axis $RA_1$ relative to the inclined guide surface 95 of the first flange ring 72 from the first dead center position 101 to the second dead center position 102 to correspondingly increase the volume of the piston chamber 50 and such that the bent cylinder sleeve 35 moves along the first rotor axis $RA_1$ toward the piston cylinder 47 with which it is associated as the bent cylinder sleeve 35 moves in the direction of rotation about the first rotor axis $RA_1$ relative to the inclined guide surface 95 of the first flange ring 72 from the second dead center position 102 to the first dead center position 101 to correspondingly decrease the volume of the piston chamber 50. In embodiments, the amount of the volume change in the piston chamber 50 between the first and second dead center positions 101, 102 can be varied by changing the inclined angle θ between the first and second rotor axes $RA_1$, $RA_2$.

In the illustrated embodiment, the second sleeve end 251 of each bent cylinder sleeve 35 is in at least intermittent contacting relationship with the inclined guide surface 195 of the second flange ring 172 of the second rotor assembly 30. Accordingly, each bent cylinder sleeve 35 is in at least intermittent contacting relationship with the inclined guide surface 95, 195 of each of the first and second flange rings 72, 172 of the first and second rotor assemblies 25, 30. Each bent cylinder sleeve 35 is rotatably movable about the second rotor axis $RA_2$ with respect to the inclined guide surface 195 of the second flange ring 172. The inclined guide surface 195 of the second flange ring 172 is configured such that the bent cylinder sleeve 35 is movable along the second rotor axis $RA_2$ relative to the piston 47 with which it is associated based upon the circumferential position of the bent cylinder sleeve 35 relative to the inclined guide surface 195 of the second flange ring 172. The inclined guide surface 195 of the second flange ring 172 is configured such that the position of the second sleeve end 251 of the bent cylinder sleeve 35 along the second rotor axis $RA_2$ relative to the piston cylinder 47 varies based upon the circumferential position of the bent cylinder sleeve 35 relative to the inclined guide surface 195 of the second flange ring 172 to correspondingly vary the volume of the piston chamber 50 defined thereby.

The inclined guide surface 195 of the second flange ring 172 is configured such that each bent cylinder sleeve 35 moves along the second rotor axis $RA_2$ away from the associated piston 47 as the respective bent cylinder sleeve 35 moves in a direction of rotation about the second rotor axis $RA_2$ relative to the inclined guide surface 195 of the second flange ring 172 from the first dead center position 101 to the second dead center position 102 to correspondingly increase the volume of the piston chamber 50 and such that the bent cylinder sleeve 35 moves along the second rotor axis $RA_2$ to increasingly receive more of the piston 47 therein as the bent cylinder sleeve 35 moves in the direction of rotation about the second rotor axis $RA_2$ relative to the inclined guide surface 195 of the second flange ring 172 from the second dead center position 102 to the first dead center position 101 to correspondingly decrease the volume of the piston chamber 50.

Referring to FIG. 8, in the illustrated embodiment, the inclined guide surfaces 95, 195 of the first and second flange rings 72, 172 are complementarily configured such that each bent cylinder sleeve 35 is constrained to move substantially in a medial plane MP as the bent cylinder sleeve 35 moves in a direction of rotation with respect to the inclined guide surfaces 95, 195 of the first and second flange rings 72, 172.

The medial plane MP bifurcates the oblique angle θ between the first and second rotor axes $RA_1$, $RA_2$. The inclined guide surface 195 of the second flange ring 172 is circumferentially complementary to the inclined guide surface 95 of the first flange ring 72 such that the intermediate joint 279 of each bent cylinder sleeve 35 is substantially aligned with the medial plane MP of the first and second rotor axes $RA_1$, $RA_2$ over a revolution of the bent cylinder sleeve 35 around the inclined guide surfaces 95, 195 of the first and second flange rings 72, 172.

The inclination of the first and second rotors 40, 43 at the inclination angle θ results in corresponding pairs of associated piston cylinders 45 and pistons 47 moving alternately closer together and then farther apart during rotation of the rotors 40, 43 (the respective limiting positions being shown in FIG. 10). The bent cylinder sleeves 35 are constrained by their angularity and the inner sidewall 97, 197 of the first and second flanges 72, 172 to maintain their alignment. Accordingly, the bent cylinder sleeves 35 undergo relative rotational movement with respect to the piston cylinder 45 and piston 47 with which each is associated as the bent cylinder sleeves 35 rotate with the first and second rotors 40, 43. At the same time, the bent cylinder sleeves 35 move axially in a reciprocal fashion relative to the piston cylinder 45 and piston 47 with which each is associated.

As one rotor 40, 43 rotates, the other rotor 43, 40 rotates in the same direction as the driving rotor in response to the transmission of torque from one rotor to the other via the bent cylinder sleeves 35 being coupled to a respective one of the piston cylinders 45 and the pistons 47 and, if desired, the gear set. As the first and second rotors 40, 43 rotate, each of the bent cylinder sleeves 35 moves reciprocally toward and away from the associated piston cylinder 45 and piston 47. The reciprocal movement of the bent cylinder sleeves 35 with respect to the associated piston cylinder 45 and piston 47 causes a corresponding reciprocal expansion and contraction of the piston chamber 50 defined therebetween. As the volume of the piston chamber 50 changes, fluid can either flow into or out of the piston chamber 50 by way of various connection ports in the port plate 70.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A rotary fluid pump-motor comprising:

a first rotor assembly, the first rotor assembly including a first rotor, a piston cylinder, and a flange ring, the first rotor being rotatably movable about a first rotor axis with respect to the flange ring, the first rotor defining a bore therethrough, the piston cylinder being mounted to the first rotor and extending therefrom along the first rotor axis to a distal cylinder end, the piston cylinder being hollow and defining an interior cylinder cavity with a proximal opening and a distal opening, the interior cylinder cavity being in fluid communication with the bore of the first rotor via the proximal opening, the flange ring including an inner perimeter defining an inner opening and an inclined guide surface circumscribing the perimeter, the piston cylinder disposed within the inner opening of the flange ring;

a second rotor assembly, the second rotor assembly including a second rotor and a piston, the second rotor being rotatably movable about a second rotor axis, the second rotor axis being inclined relative to the first rotor axis such that the second rotor axis is in non-parallel relationship with the first rotor axis, the piston being mounted to the second rotor and extending therefrom along the second rotor axis to a distal piston end; and a bent cylinder sleeve, the bent cylinder sleeve including a first sleeve segment with a first sleeve end defining a first sleeve opening and a second sleeve segment with a second sleeve end defining a second sleeve opening, the first and second sleeve segments respectively extending along the first and second rotor axes, the bent cylinder sleeve being hollow and defining an interior sleeve cavity in communication with the first sleeve opening and the second sleeve opening;

wherein the piston cylinder extends through the first sleeve opening such that the distal cylinder end of the piston cylinder is disposed within the first sleeve segment, and the piston extends through the second sleeve opening such that the distal piston end of the piston is disposed within the second sleeve segment, the piston cylinder, the bent cylinder sleeve, and the piston defining a piston chamber therebetween, the bent cylinder sleeve thereby rotatively coupling the first rotor and the second rotor;

wherein the first sleeve end of the bent cylinder sleeve is in at least intermittent contacting relationship with the inclined guide surface of the flange ring of the first rotor assembly, the bent cylinder sleeve being rotatably movable about the first rotor axis with respect to the inclined guide surface, the inclined guide surface configured such that a position of the first sleeve end of the bent cylinder sleeve along the first rotor axis relative to the piston cylinder varies based upon a circumferential position of the bent cylinder sleeve relative to the inclined guide surface to correspondingly vary a volume of the piston chamber.

2. The rotary fluid pump-motor according to claim 1, wherein the inclined guide surface includes a first dead center position and a second dead center position in axial offset relationship to the first dead center position along the first rotor axis, the piston chamber having a first volume when the bent cylinder sleeve is positioned at the first dead center position and a second volume when the bent cylinder sleeve is positioned at the second dead center position, the second volume being greater than the first volume.

3. The rotary fluid pump-motor according to claim 2, wherein the first and second dead center positions are in circumferential opposing relationship to each other about the inner perimeter.

4. The rotary fluid pump-motor according to claim 3, wherein the inclined guide surface includes a pair of ramp segments extending circumferentially between the first dead center position and the second dead center position, the ramp segments being mirror images of each other.

5. The rotary fluid pump-motor according to claim 4, wherein the inclined guide surface is configured such that the first sleeve end of the bent cylinder sleeve is reciprocally movable along the first rotor axis relative to the piston cylinder over a range of travel between a minimum volume position and a maximum volume position over each revolution of the bent cylinder sleeve around the inclined guide surface.

6. The rotary fluid pump-motor according to claim 1, wherein the first rotor assembly includes a port plate, the first rotor being rotatably movable about the first rotor axis with respect to the port plate, the port plate defining a first fluid passage and a second fluid passage, the second fluid passage being fluidly isolated from the first fluid passage, the first and second fluid passages being configured such that the bore of the first rotor is in periodic cyclical fluid communication with the first fluid passage and the second fluid passage based upon movement of the first rotor about the first rotor axis with respect to the port plate.

7. The rotary fluid pump-motor according to claim 6, wherein the inclined guide surface includes a first dead center position and a second dead center position in axial offset relationship to the first dead center position along the first rotor axis, the piston chamber having a first volume when the bent cylinder sleeve is positioned at the first dead center position and a second volume when the bent cylinder sleeve is positioned at the second dead center position, the second volume being greater than the first volume, the bore of the first rotor being in fluid communication with the first fluid passage when the bent cylinder sleeve is positioned at the first dead center position and with the second fluid passage when the bent cylinder sleeve is positioned at the second dead center position.

8. The rotary fluid pump-motor according to claim 1, wherein the flange ring of the first rotor assembly comprises a first flange ring, and the second rotor assembly includes a second flange ring, the second rotor being rotatably movable about the second rotor axis with respect to the second flange ring, the second flange ring including an inner perimeter defining an inner opening and an inclined guide surface circumscribing the perimeter, the piston being disposed within the inner opening of the second flange ring, wherein the second sleeve end of the bent cylinder sleeve is in at least intermittent contacting relationship with the inclined guide surface of the second flange ring of the second rotor assembly, the bent cylinder sleeve being rotatably movable about the second rotor axis with respect to the inclined guide surface of the second flange ring, the inclined guide surface of the second flange ring configured such that the second sleeve end of the bent cylinder sleeve is movable along the second rotor axis relative to the piston based upon the circumferential position of the bent cylinder sleeve relative to the inclined guide surface of the second flange ring.

9. The rotary fluid pump-motor according to claim 8, wherein the first rotor axis and the second rotor axis define an oblique angle therebetween, the first and second segments of the bent cylinder sleeve are connected together at an intermediate joint, and the inclined guide surface of the second flange ring is circumferentially complementary to the inclined guide surface of the first flange ring such that the intermediate joint of the bent cylinder sleeve is is positioned along a medial plane of the first and second rotor axes over a revolution of the bent cylinder sleeve around the inclined guide surfaces of the first and second flange rings, the medial plane bifurcating the oblique angle.

10. The rotary fluid pump-motor according to claim 8, wherein the first and second rotors each includes a gear respectively projecting along the first and second rotor axes, the gears in enmeshed relationship with each other to constrain the first and second rotors to rotate in phase with each other about the first and second rotor axes, respectively.

11. The rotary fluid pump-motor according to claim 1, wherein at least one of the first and second rotors is rotatively coupled to a shaft extending along the respective first and second rotor axes.

12. A rotary fluid pump-motor comprising:

a first rotor assembly, the first rotor assembly including a first rotor and a plurality of piston cylinders, the first rotor being rotatably movable about a first rotor axis, the piston cylinders being mounted to the first rotor about the first rotor axis in circumferential spaced relationship to each other, each of the piston cylinders extending from the first rotor along the first rotor axis to a distal cylinder end, each piston cylinder being hollow and defining an interior cylinder cavity with a distal opening at the distal cylinder end;

a second rotor assembly, the second rotor assembly including a second rotor and a plurality of pistons corresponding to the plurality of piston cylinders, the second rotor being rotatably movable about a second rotor axis, the second rotor axis being inclined relative to the first rotor axis such that the second rotor axis is in non-parallel relationship with the first rotor axis, the pistons being mounted to the second rotor about the second rotor axis in circumferential spaced relationship to each other, each of the pistons extending from the second rotor along the second rotor axis to a distal piston end; and a plurality of bent cylinder sleeves corresponding to the piston cylinders and the pistons, each bent cylinder sleeve being hollow and defining an interior sleeve cavity with a first sleeve opening and a second sleeve opening, each bent cylinder sleeve having an exterior surface with a sidewall surface and a land surface projecting radially outwardly from the sidewall surface, the bent cylinder sleeves rotatively coupled with a respective one of the piston cylinders and one of the pistons by receiving therein said one of the piston cylinders through the first sleeve opening and said one of the pistons through the second sleeve opening;

wherein the bent cylinder sleeves are circumferentially arranged with respect to each other such that the land surface of each bent cylinder sleeve is in at least intermittent contacting relationship with the land surface of at least one adjacent bent cylinder sleeve.

13. The rotary fluid pump-motor according to claim 12, wherein the first rotor assembly includes a flange ring, the first rotor being rotatably movable about the first rotor axis with respect to the flange ring, the flange ring including an inclined guide surface and an inner perimeter defining an inner opening, the piston cylinder disposed within the inner opening of the flange ring, the inclined guide surface being a closed loop circumscribing the perimeter and being inclined such that a distance along the first rotor axis between the inclined guide surface and a proximal opening of the piston cylinder varies along a circumference of the inclined guide surface, each respectively coupled piston cylinder, bent cylinder sleeve, and piston defining a piston chamber therebetween, each bent cylinder sleeve in at least intermittent contacting relationship with the inclined guide surface of the flange ring, and wherein each bent cylinder sleeve is rotatably movable about the first rotor axis with respect to the inclined guide surface such that the bent cylinder sleeve moves along the first rotor axis relative to the piston cylinder based upon a circumferential position of the respective bent cylinder sleeve along the inclined guide surface to correspondingly vary a volume of the respective piston chamber.

14. The rotary fluid pump-motor according to claim 12, wherein each bent cylinder sleeve includes a first sleeve segment with a first sleeve end and the first sleeve opening and a second sleeve segment with a second sleeve end and a second sleeve opening, the first and second sleeve segments respectively extending along the first rotor axis and the second rotor axis, and the land surface of each bent cylinder sleeve is disposed at one of the first sleeve end and the second sleeve end.

15. The rotary fluid pump-motor according to claim 14, wherein, for each bent cylinder sleeve, the land surface comprises a first land surface, each bent cylinder sleeve including a second land surface projecting radially outwardly from the sidewall surface, the first and second land surfaces being disposed respectively at the first and second sleeve ends.

16. The rotary fluid pump-motor according to claim 15, wherein the bent cylinder sleeves are circumferentially arranged with respect to each other such that the first and second land surfaces of each bent cylinder sleeve are in respective contacting relationship with the first and second land surfaces of a pair of adjacent bent cylinder sleeves.

17. A rotary fluid pump-motor comprising:

a first rotor assembly, the first rotor assembly including a first rotor, a piston cylinder, and a flange ring, the first rotor being rotatably movable about a first rotor axis with respect to the flange ring, the piston cylinder being mounted to the first rotor and extending therefrom along the first rotor axis, the piston cylinder being hollow and defining an interior cylinder cavity with a proximal opening and a distal opening, the flange ring including an inclined guide surface and an inner perimeter defining an inner opening, the piston cylinder disposed within the inner opening of the flange ring, the inclined guide surface being a closed loop circumscribing the perimeter and being inclined such that a distance along the first rotor axis between the inclined guide surface and the proximal opening of the piston cylinder varies along a circumference of the inclined guide surface;

a second rotor assembly, the second rotor assembly including a second rotor and a piston, the second rotor being rotatably movable about a second rotor axis, the second rotor axis being inclined relative to the first rotor axis such that the second rotor axis is in non-parallel relationship with the first rotor axis, the piston being mounted to the second rotor and extending therefrom along the second rotor axis; and a bent cylinder sleeve, the bent cylinder sleeve being hollow and defining an interior sleeve cavity with first and second sleeve openings, the bent cylinder sleeve rotatively coupled with the piston cylinder and the piston by receiving therein said piston cylinder through the first sleeve opening and the piston through the second sleeve opening, the interior sleeve cavity in fluid communication with the interior cylinder cavity, the piston cylinder, the bent cylinder sleeve, and the piston defining a piston chamber therebetween, the bent cylinder sleeve in at least intermittent contacting relationship with the inclined guide surface of the flange ring;

wherein the bent cylinder sleeve is rotatably movable about the first rotor axis with respect to the inclined guide surface such that the bent cylinder sleeve moves along the first rotor axis relative to the piston cylinder based upon a circumferential position of the bent cylinder sleeve along the inclined guide surface to correspondingly vary a volume of the piston chamber.

18. The rotary fluid pump-motor according to claim 17, wherein the inclined guide surface includes a first dead center position and a second dead center position in axial offset relationship to the first dead center position along the first rotor axis, and the inclined guide surface is configured such that the bent cylinder sleeve moves along the first rotor axis away from the piston cylinder as the bent cylinder sleeve moves in a direction of rotation about the first rotor axis relative to the inclined guide surface from the first dead center position to the second dead center position to correspondingly increase the volume of the piston chamber and such that the bent cylinder sleeve moves along the first rotor axis toward the piston cylinder as the bent cylinder sleeve moves in the direction of rotation about the first rotor axis relative to the inclined guide surface from the second dead center position to the first second dead center position to correspondingly decrease the volume of the piston chamber.

19. The rotary fluid pump-motor according to claim 17, wherein the flange ring of the first rotor assembly comprises a first flange ring, and the second rotor assembly includes a second flange ring, the second rotor being rotatably movable about the second rotor axis with respect to the second flange ring, the second flange ring including an inner perimeter defining an inner opening and an inclined guide surface circumscribing the perimeter, the piston being disposed within the inner opening of the second flange ring, wherein the bent cylinder sleeve is in at least intermittent contacting relationship with the inclined guide surface of the second flange ring of the second rotor assembly, the bent cylinder sleeve being rotatably movable about the second rotor axis with respect to the inclined guide surface of the second flange ring, the inclined guide surface of the second flange ring configured such that the bent cylinder sleeve is movable along the second rotor axis relative to the piston based upon the circumferential position of the bent cylinder sleeve relative to the inclined guide surface of the second flange ring.

20. The rotary fluid pump-motor according to claim 19, wherein the inclined guide surfaces of the first and second flange rings are complementarily configured such that the bent cylinder sleeve is constrained to move along a medial plane as the bent cylinder sleeve moves in a direction of rotation with respect to the inclined guide surfaces of the first and second flange rings.

* * * * *